US005329169A

United States Patent [19]

Ihara

[11] Patent Number: 5,329,169

[45] Date of Patent: Jul. 12, 1994

[54] VOLTAGE DROPPING CIRCUIT FOR SEMICONDUCTOR DEVICE

[75] Inventor: Makoto Ihara, Sakurai, Japan

[73] Assignee: Sharp Kabushiki Kaisha, Osaka, Japan

[21] Appl. No.: 936,349

[22] Filed: Aug. 28, 1992

[30] Foreign Application Priority Data

Aug. 28, 1991 [JP] Japan ..... 3-217583

[51] Int. Cl.[5] ..... G05F 3/02

[52] U.S. Cl. ..... 307/296.3; 307/264

[58] Field of Search ..... 307/296.1, 296.5, 296.6, 307/573, 585, 608, 571, 471, 296.3, 264; 365/227, 189.9

[56] References Cited

U.S. PATENT DOCUMENTS

| | | | |
|---|---|---|---|
| 4,103,190 | 7/1978 | Beutler | 307/585 |
| 4,305,009 | 12/1981 | Miyagawa et al. | 307/585 |
| 5,025,181 | 6/1991 | Farmer | 307/585 |
| 5,124,574 | 6/1992 | Ibaraki | 365/189.09 |
| 5,126,603 | 6/1992 | Hattori | 307/573 |
| 5,187,685 | 2/1993 | Sato et al. | 365/189.09 |

OTHER PUBLICATIONS

"A 1.5V Circuit Technology for 64Mb Drams" Nakagome et al., Jun. 7-9, 1990, pp. 17-18.
The 1990 Symposium of VLSI Circuits, Digest of Technical Papers.

*Primary Examiner*—Timothy P. Callahan
*Assistant Examiner*—My-Trang Nu Ton

[57] ABSTRACT

A voltage dropping circuit for a semiconductor device is provided. The voltage dropping circuit includes a control unit for producing a reference voltage from a first specified voltage, an output unit for generating a second specified voltage which is a half of the first specified voltage in accordance with the reference voltage, a timer circuit for generating a driving pulse which becomes active intermittently, and a switch circuit for operating the control unit when the driving pulse is active and stopping the operation of the control unit when the driving pulse is not active.

8 Claims, 5 Drawing Sheets

VOLTAGE DROPPING CIRCUIT FOR SEMICONDUCTOR DEVICE

BACKGROUND OF THE INVENTION

1. Field of the Invention

The present invention relates to a voltage dropping circuit for a semiconductor device, and more particularly, it relates to a voltage dropping circuit with which power consumption during a standby time can be reduced.

2. Description of the Related Art

In recent years, semiconductor integrated circuits have been increasingly miniaturized. In particular, this tendency is most noticeable in dynamic RAMs. With the miniaturization of transistors, their supply voltage must be reduced for various reasons, such as lifetime shortening of transistors caused by hot electrons. For example, the supply voltage for transistors having a 0.6 μm gate length must be 4 V or less (e.g., 3.3 V),in general, while the supply voltage which has conventionally been widely used for ICs is 5 V. Consequently, an internal voltage dropping circuit has been used in ICs so that the supply voltage from outside is reduced from 5 V to 3.3 V to be applied to transistors inside.

FIG. 5 is a circuit diagram showing the constitution of a conventional (½) $V_{CC}$ voltage generating circuit as the internal voltage dropping circuit for a semiconductor device.

As shown in FIG. 5, the conventional (½) $V_{CC}$ voltage generating circuit for a semiconductor device is composed of an output transistor control unit 1 and an output transistor unit 2. The output transistor control unit 1 includes two resistors 1*a* and 1*b* for dividing a $V_{CC}$ supply voltage, an n-channel FET 1*c* and a p-channel FET 1*d* which are connected therebetween. A voltage increase control terminal 1*e* outputs a reference voltage which is higher than half the $V_{CC}$ supply voltage ((½) $V_{CC}$ voltage) by the pinch-off voltage of the FET 1*c*, while a voltage decrease control terminal 1*f* outputs a reference voltage which is lower than the (½) $V_{CC}$ voltage by the pinch-off voltage of the FET 1*d*.

The output transistor unit 2 includes an n-channel FET 2*a* which is connected between the $V_{CC}$ power supply and a (½) $V_{CC}$ power supply terminal 3 and a p-channel FET 2*b* which is connected between the (½) $V_{CC}$ power supply terminal 3 and ground. The reference voltages from the voltage increase control terminal 1*e* and voltage decrease control terminal 1*f* are applied to the gates of the FETs 2*a* and 2*b*, respectively. When the actual voltage at the (½) $V_{CC}$ power supply terminal 3 becomes lower than the (½) $V_{CC}$ voltage, the FET 2*a* is activated. In contrast, when the actual voltage at the (½) $V_{CC}$ power supply terminal 3 exceeds the (½) $V_{CC}$ voltage, the FET 2*b* is activated, thus maintaining the (½) $V_{CC}$ voltage supplied from the (½) $V_{CC}$ power supply terminal 3.

The foregoing conventional (½) $V_{CC}$ voltage generating circuit is designed so that the output transistor control unit 1 always allows the passage of driving current therethrough. However, it has been desired particularly in recent years to minimize the power consumption of semiconductor devices on standby, because of their battery driving and for other reasons.

The conventional (½) $V_{CC}$ voltage generating circuit is therefore disadvantageous in that the presence of driving current in the output transistor control unit 1 prevents the power consumption of a semiconductor device from decreasing during a standby time.

An application of the (½) $V_{CC}$ voltage generating circuit to DRAMs as semiconductor devices is disclosed in Jun. 7th, 1990 IEEE Symposium on VLSI Circuits, A 1.5 V Circuit Technology for 64 Mb DRAMs, pp 17–18, which shows a schematic view of the conventional (½) $V_{CC}$ voltage generating circuit in FIG. 15 thereof.

SUMMARY OF THE INVENTION

The present invention provides a voltage dropping circuit for a semiconductor device comprising: a control unit for producing a reference voltage from a first specified voltage; an output unit for generating a second specified voltage which is a half of said first specified voltage on the basis of said reference voltage; a timer circuit for generating a driving pulse which becomes active intermittently; and a switch circuit for operating said control unit when said driving pulse is active and stopping the operation of said control unit when said driving pulse is not active.

Said switch circuit preferably connects said control unit to the power source of said first specified voltage when said driving pulse is active and disconnects said control unit therefrom when said driving pulse is not active.

Said timer circuit preferably generates a driving pulse having a fixed duration at fixed time intervals.

According to the present invention, the power consumption in a standby state of a semiconductor device, for example, a dynamic random access memory can be reduced by intermittently generating the reference voltage for the second specified voltage, while the second specified voltage, which is a half of the first specified voltage, is maintained.

BRIEF DESCRIPTION OF THE DRAWINGS

An embodiment of the invention will now be described by way of example and with reference to the accompanying drawings, in which.

DESCRIPTION OF THE PREFERRED EMBODIMENTS

Figure 5:
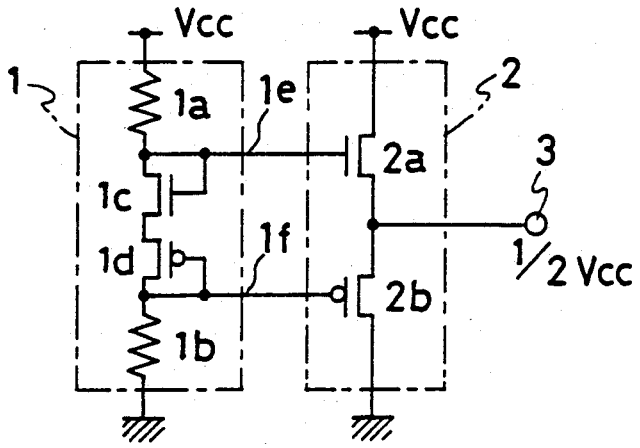
FIG. 5 PRIOR ART
FIG. 5 is a circuit diagram showing the constitution of a conventional (½) $V_{CC}$ voltage generating circuit.

Preferred embodiments of the present invention will be described below with reference to the drawings in which like components that have the same functions as those of the known components shown above in FIG. 5 are designated by like reference numerals.

Figure 1:
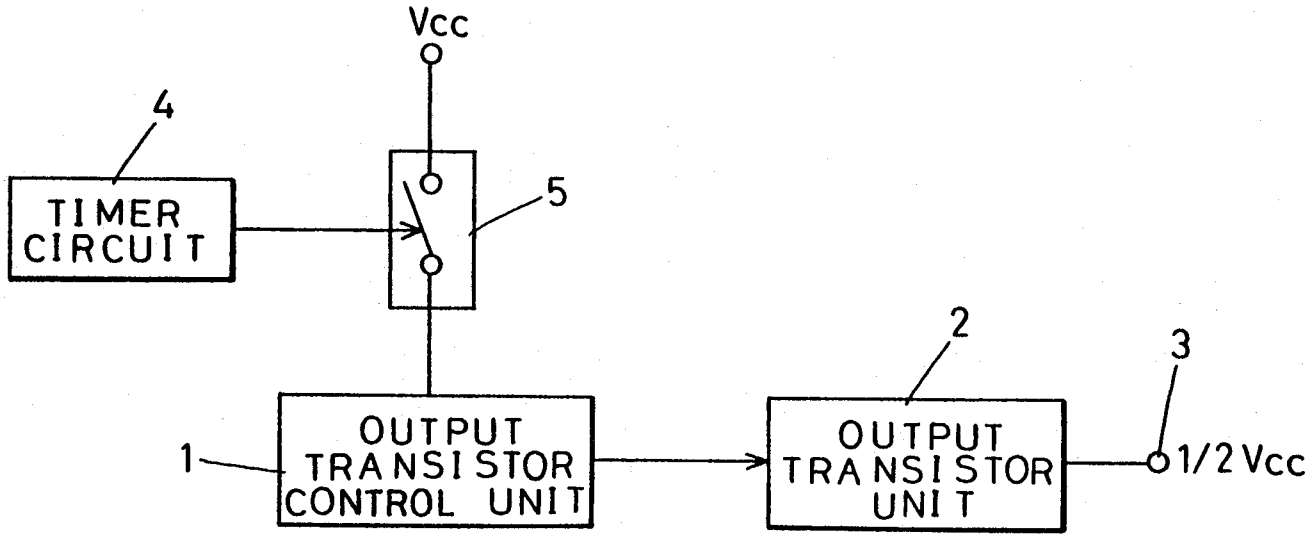
FIG. 1 is a block diagram schematically showing the constitution of a (½) $V_{CC}$ voltage generating circuit for a dynamic random access memory, embodying the present invention.

As shown in FIG. 1, when a driving pulse from a timer circuit 4 becomes active a switch circuit 5 connects an output transistor control unit 1 to a $V_{CC}$ power supply. The output transistor control unit 1 then generates a reference voltage so that an output transistor unit 2, based on the reference voltage, supplies half the $V_{CC}$ supply voltage ((½) $V_{CC}$ voltage) to a (½) $V_{CC}$ power supply terminal 3.

When the driving pulse from the timer circuit 4 becomes inactive, in contrast, the switch circuit 5 cuts off the output transistor control unit 1 from the $V_{CC}$ power supply so as to prevent the driving current from passing through the output transistor control unit 1, thereby reducing the power consumption in the meantime. In the case that the voltage at the (½) $V_{CC}$ power supply terminal 3 fluctuates from the (½) $V_{CC}$ voltage during this period, the voltage can be corrected when the driving pulse from the timer circuit 4 becomes active again.

Figure 2:
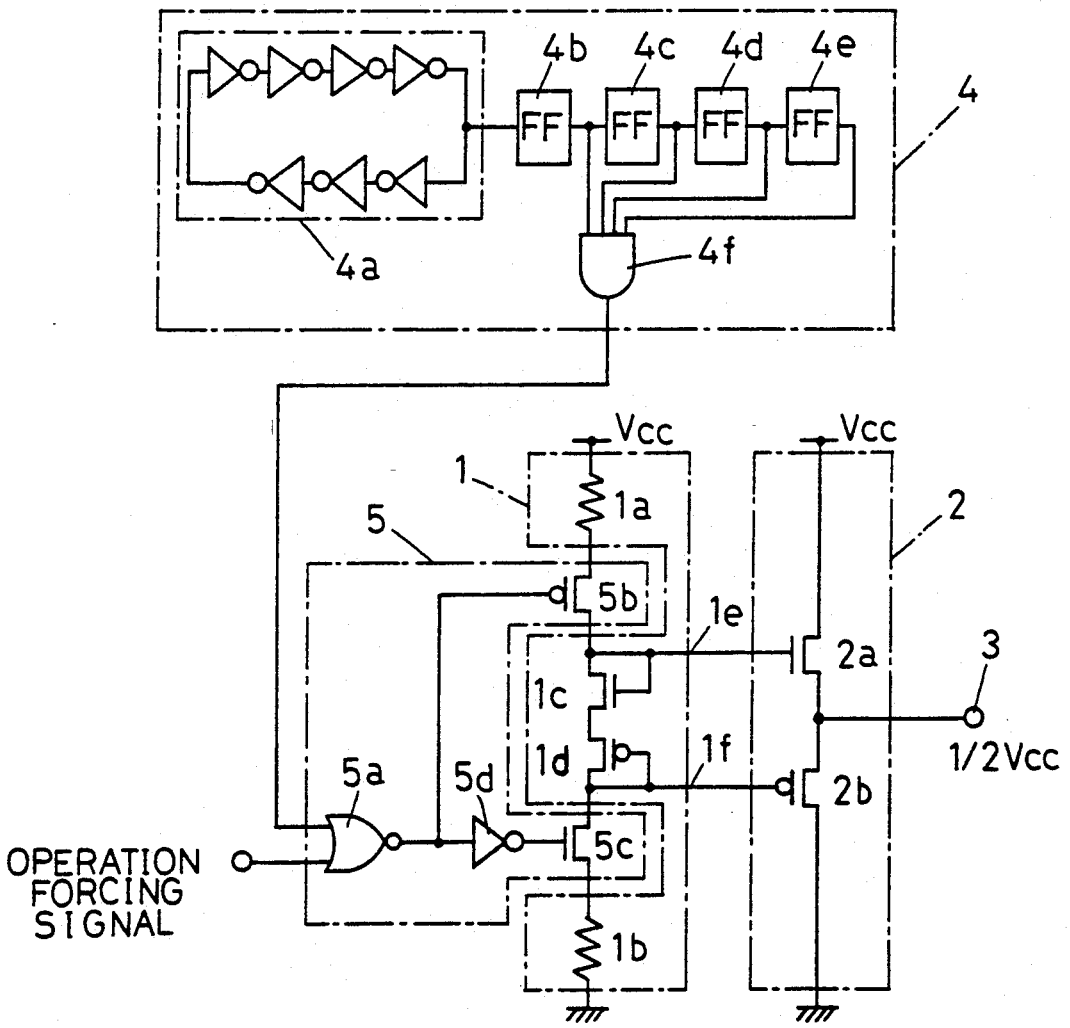
FIG. 2 is a circuit diagram showing in detail the constitution of the embodiment of the invention.

The constitution of the present embodiment will be described in detail with reference to FIG. 2. Similarly to the known circuit shown above in FIG. 5, the output transistor control unit 1 includes two resistors 1*a* and 1*b* for dividing the $V_{cc}$ supply voltage, an n-channel FET 1*c* and a p-channel FET 1*d* which are connected therebetween. Also similarly to the known circuit the output transistor unit 2 includes an n-channel FET 2*a* connected between the $V_{CC}$ power supply and the (½) $V_{CC}$ power supply terminal 3 and a p-channel FET 2*b* connected between the (½) $V_{CC}$ power supply terminal 3 and ground. The FETs 2*a* and 2*b* of the output transistor unit 2 are designed to operate in accordance with the reference voltages from the voltage increase control terminal 1*e* and the voltage decrease control terminal 1*f* of the output transistor control unit 1, so as to supply the (½) $v_{CC}$ voltage from the (½) $V_{CC}$ power supply terminal 3. However, the $V_{CC}$ voltage supplied to the output transistor control unit 1 is controlled by the switch circuit 5.

Next, the constitution and operation of the timer circuit 4 will be described with reference to FIGS. 3 and 4.

The timer circuit 4 includes a ring oscillator 4*a*, four toggle-type flip-flop circuits 4*b* to 4*e* and an AND circuit 4*f*. The ring oscillator 4*a* is composed of a plurality of inverters connected in the shape of a ring and sequentially outputs pulses at an equal duty ratio, as shown in FIG. 4(1).

Figure 3:
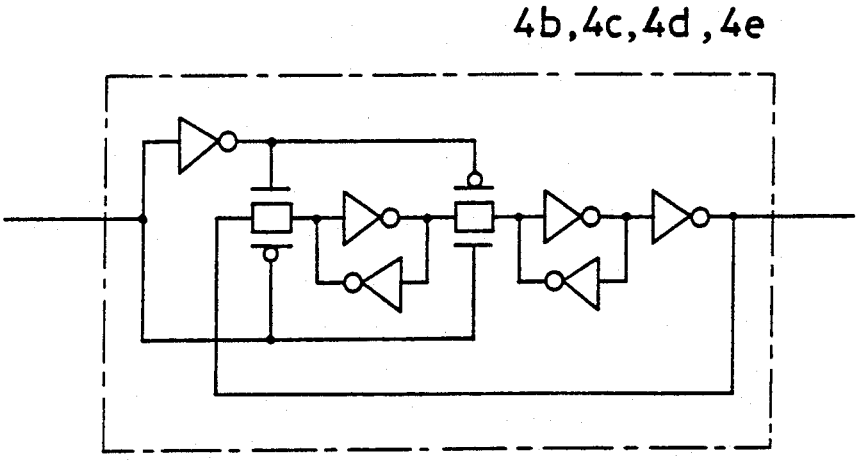
FIG. 3 is a circuit diagram showing the constitution of a toggle-type flip-flop circuit used in the embodiment of the present invention.
Figure 4:
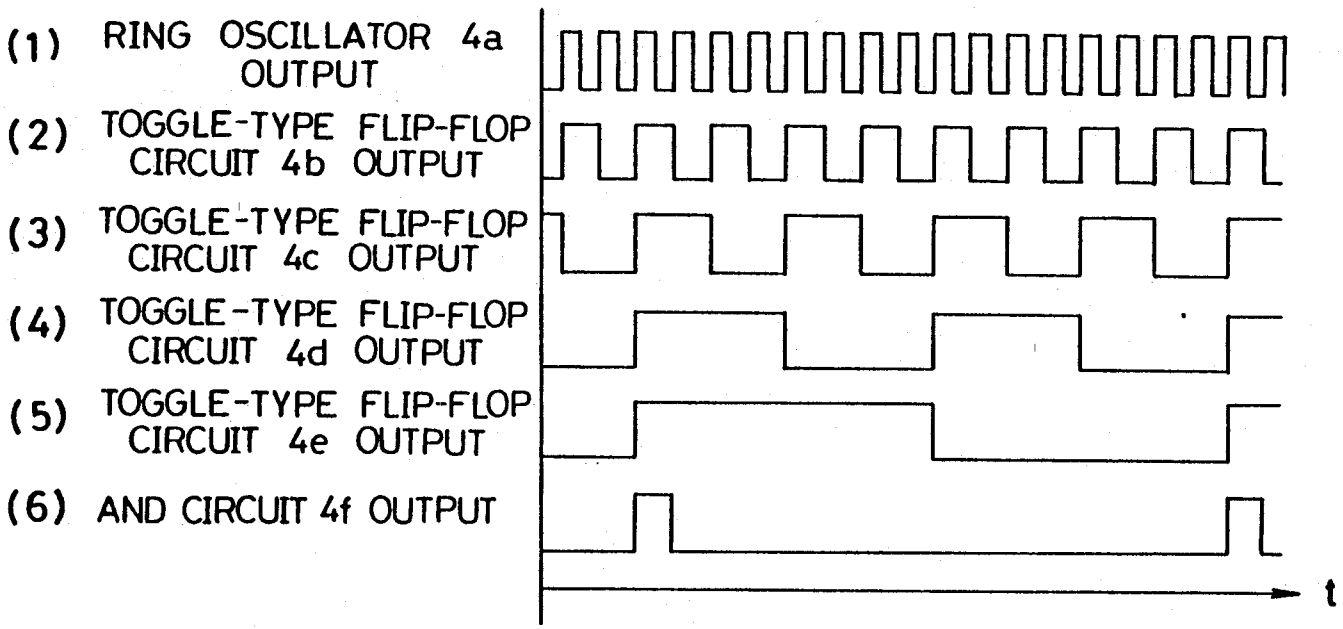
FIG. 4 is a timing chart showing the wave forms of individual parts of a timer circuit in FIG. 2.

FIG. 3 shows the toggle-type flip-flop circuits 4*b* to 4*e* which, each time the input level is switched between HIGH and LOW, operate to input the output from one duplex inverter circuit to the other duplex inverter circuit, or vice versa. Thus, as shown in FIGS. 4(2) to 4(5), these toggle-type flip-flop circuits 4*b* to 4*e* perform a toggle operation in which the output level switches between HIGH and LOW each time the input level switches from LOW to HIGH, thereby successively dividing the frequency of an input pulse to half. The AND circuit 4*f* serves to calculate the AND logical product of the output from each of the toggle-type flip-flop circuits 4*b* to 4*e*. As shown in FIG. 4(6), the AND circuit 4*f* outputs a driving pulse which becomes active (HIGH level) during a time interval corresponding to one out of sixteen frequencies of the pulse oscillated by the ring oscillator 4*a*. The driving pulse outputted from the AND circuit 4*f* of the timer circuit 4 is inputted to the switch circuit 5.

Next, the constitution of the switch circuit 5 will be described. The switch circuit 5 includes a NOR circuit 5*a*, a p-channel FET 5*b*, an n-channel FET 5*c* and an inverter 5*d*. The driving pulse from the timer circuit 4 is inputted to the NOR circuit 5*a*. To the other input of the NOR circuit 5*a* is inputted an operation forcing signal (HIGH level), by which the output transistor control unit 1 can be activated irrespective of the output from the timer circuit 4. The output of the NOR circuit 5*a*, which is connected directly to the gate of the p-channel FET 5*b*, is also connected to the gate of the n-channel p-channel FET 5*c* via the inverter 5*d*. The FET 5*b* is connected between the resistor 1*a* and the n-channel FET 1*c* the output transistor control unit 1, while the n-channel FET 5*c* is connected between the p-channel FET 1*d* and resistor 1*b* in the output transistor control unit 1. Hence, the power supply to the output transistor control unit 1 is controlled by the switch circuit 5.

It should be noted that the operation forcing signal is inputted upon actuation of the semiconductor device.

Next,the operation of the (½) $V_{CC}$ voltage generating circuit provided with the timer circuit 4 and the switch circuit 5 will be described.

When the driving pulse from the timer circuit 4 is inputted to the switch circuit 5, the output level of the NOR circuit 5*a* becomes LOW only during the period in which the driving pulse is active (HIGH level), thereby turning on both the FETs 5*b* and 5*c*. As a result, the output transistor control unit 1 is connected to the power supply and the reference voltages are outputted from the voltage increase control terminal 1*e* and voltage decrease control terminal 1*f* so that the output transistor unit 2 provides the (½) $V_{CC}$ power supply terminal 3 with the (½) $V_{cc}$ voltage, similarly to the known art.

When the driving pulse is not active, in contrast, the output level of the NOR circuit 5*a* of the switch circuit 5 becomes HIGH, thereby turning off both the FETs 5*b* and 5*c*. As a result, the output transistor control unit 1 is cut off from the power supply with no more driving current passing therethrough, so that the power consumption can be reduced in the meantime. Moreover, since the voltage increase control terminal 1*e* and the voltage decrease control terminal 1*f* are at high impedance during this period, the FETs 2*a* and 2*b* of the output transistor unit 2 are kept off, thus eliminating the risk that the (½) $V_{CC}$ power supply terminal 3 is accidentally connected to the $V_{CC}$ power supply or to ground.

Thus, in accordance with the present embodiment, the output transistor control unit 1 does not constantly allow the driving current to pass therethrough, for the output transistor control unit 1 operates only when the driving pulse from the timer circuit 4 becomes active intermittently, resulting in a reduced power consumption of a semiconductor device on standby.

While the present invention has been described with reference to a preferred embodiment thereof, it will be understood by those skilled in the art that various changes may be made without departing from the spirit or scope of the invention.

What is claimed is:

1. A voltage dropping circuit mounted on a semiconductor device for controlling a voltage supplied to a DRAM, comprising:

a control unit for producing for a predetermined period a reference voltage set to one half of a supply voltage connected thereto with a bias circuit comprising first and second resistors having equal values and first and second transistors;

an output unit for outputting to the DRAM a predetermined voltage having a value half of said supply voltage by level shifting said reference voltage produced by said control unit with an output circuit comprising first and second complementary transistors;

a timer circuit for generating a driving pulse which becomes an active signal intermittently; and a switching circuit for utilizing said driving pulse from said timer circuit to switch said supply voltage supplied to said control unit, said switching circuit simultaneously suspends said control unit and said output unit when said driving pulse fails to provide said active signal to hold a high impedance and cut said predetermined voltage supplied to the DRAM, and when said output unit supplied said predetermined voltage to the DRAM, said switching circuit intermittently switch said control unit with said driving pulse transmitted from said timer circuit to decrease the power consumed by said control unit, said output unit and the DRAM.

2. A voltage dropping circuit mounted on a semiconductor device according to claim 1, wherein said switching circuit comprises first and second switching transistors from switching said supply voltage to said supply voltage supplied to said control unit and a gate circuit for validating said driving pulse from said timer circuit when the DRAM is inactive; said switching circuit in connected in such a manner that said supply voltage is supplied to said control unit when said active signal provided by said driving pulse is transmitted to said gate circuit; and said switching circuit holds both said control count and said output unit in a high impedance by separating said supply voltage from said control unit to cut off power consumption when said active signal provided by said driving pulse fails to be transmitted to said gate circuit.

3. A voltage dropping circuit for a semiconductor device according to claim 1, wherein said timer circuit comprises an oscillator for generating said driving pulse having a fixed duration at fixed time intervals, a flip-flop circuit and a gate circuit.

4. A voltage dropping circuit for a semiconductor device according to claim 1, wherein said switching circuit comprises a switching element having an n-channel FET and a p-channel FET.

5. A voltage dropping circuit for a semiconductor device according to claim 1, wherein said timer circuit comprises a pulse generator composed of a ring oscillator and a frequency dividing circuit composed of a toggle-type flip-flop circuit.

6. A method of voltage dropping for a semiconductor device, comprising the steps of:

(a) producing a reference voltage from a first specified voltage by a control unit;

(b) generating for a predetermined period a second specified voltage which is a half of said first specified voltage on the basis of said reference voltage;

(c) generating a driving pulse which becomes active intermittently;

(d) operating said control unit to produce said reference voltage when said driving pulse is active; and (e) stopping the operation of said control unit when said driving pulse fails to be active.

7. A method of voltage dropping according to claim 6, wherein said step (d) connects said control unit to said first specified voltage by a switching element when said driving pulse is active and said step (e) disconnects said control unit from said first specified voltage when said driving pulse fails to be active.

8. A method of voltage dropping according to claim 6, wherein said step (c) generates said driving pulse having a fixed duration at fixed time intervals by an oscillator.

* * * * *